US005848326A

United States Patent [19]

Komuro et al.

[11] Patent Number: 5,848,326

[45] Date of Patent: Dec. 8, 1998

[54] TONER CONVEYING METHOD AND DEVICE FOR AN IMAGE FORMING APPARATUS

[75] Inventors: Ichiroh Komuro; Junichi Terai, both of Yokohama, Japan

[73] Assignee: Ricoh Company, Ltd., Tokyo, Japan

[21] Appl. No.: 954,059

[22] Filed: Oct. 20, 1997

[30] Foreign Application Priority Data

Oct. 18, 1996 [JP] Japan ..... 8-276228
Mar. 12, 1997 [JP] Japan ..... 9-057802

[51] Int. Cl.[6] ..... G03L 21/00

[52] U.S. Cl. ..... 399/98; 399/359

[58] Field of Search ..... 399/92, 93, 98, 399/255, 258, 359

[56] References Cited

U.S. PATENT DOCUMENTS 3,894,514 7/1975 Caudill et al. ..... 399/93
5,521,690 5/1996 Taffler et al. ..... 399/93

FOREIGN PATENT DOCUMENTS 4-9082 1/1992 Japan .
6-11966 1/1994 Japan .
7-219329 8/1995 Japan .

*Primary Examiner*—Joan H. Pendegrass
*Attorney, Agent, or Firm*—Oblon, Spivak, McClelland, Maier & Neustadt, P.C.

[57] ABSTRACT

An image forming method and apparatus in which collected toner removed from a photoconductive medium by a cleaning device is conveyed to a developing device. The conveying device includes a powder pump having a rotor and a stator configured to convey the collected toner in an coaxial direction of said rotor. An air flow is supplied to the powder pump by way of an air pump, where the air is conveyed in a tube with the collected toner. The tube is connected to the developing device so that the collected toner is recycled. When the developing device is replenished with fresh toner from a toner bottle, the air pump stops supplying the air flow to the powder pump so as to prevent toner from scattering within the image forming apparatus from an opening of the developing device.

17 Claims, 10 Drawing Sheets

TONER CONVEYING METHOD AND DEVICE FOR AN IMAGE FORMING APPARATUS

BACKGROUND OF THE INVENTION

1. Field of the Invention

The present invention relates to an image forming method and apparatus such as a copier, a printer, a facsimile machine or similar electrophotographic image forming apparatus. More particularly, the invention relates to a toner conveying method and device for the image forming apparatus.

2. Discussion of Background

Some conventional image forming apparatuses have a cleaning device for removing and collecting residual toner that remains on an image bearing member (e.g., a photoconductive drum) after image transfer. The toner collected by the cleaning device is conveyed to either a developing device or a toner storing section, independent of the cleaning device.

Different schemes have been proposed for the conveyance of the collected toner. For example, as described in Japanese Laid-Open Patent No. 56-46281, a toner outlet portion that is included in the cleaning device is connected to the toner storing section by a tube accommodating a coil screw therein. Rotation of the coil screw urges the collected toner through the tube and away from where it is collected.

As recognized by the present inventors, the tube and coil screw scheme suffer from various limitations. For example, the coil screw must be extendable to the vicinity of the toner storing section or the developing device, wherever is destined. To ensure the coil screw will be able to rotate, the path for conveying the collected toner must be configured as a linear path or a path with a gradual curve, not sharply angled paths. Further, significant frictional loads between the coil screw and the tube increases the torque necessary for rotating the coil screw in the tube, which makes it difficult to convey the collected toner over a long distance and requires a large, bulky drive section to satisfactorily drive the coil screw. The large bulky drive section makes it is difficult to simplify the apparatus, to insure durability, and to facilitate maintenance. Moreover, because there are limited options for mounting the relatively large toner conveying device, the size and complexity of the device increases the cost of the apparatus.

Japanese application No. 7-339182 discloses another scheme for conveying the collected toner using a screw pump, generally referred to as a Mono pump, instead of the coil screw. Unlike the tube and coil screw scheme where the collected toner is conveyed by a mechanical member (e.g., the coil screw) disposed in the tube, the air pump scheme does not include a mechanical member. Accordingly, the air pump scheme enables the use of a flexible tube as a toner conveying path, and enables the relative positions of a photoconductive drum, a developing device and cleaning device to be accommodated in a variety of arrangements. As recognized by the present inventors, an image forming apparatus that uses a toner collecting system with the air pump is relatively simplistic in structure and low in cost relative to the tube and screw coil scheme. Further, since a load exerted on the collected toner is small, the collected toner does not adhere to the tube.

The pressure in the tube in the air pump scheme is reduced at a joint between the tube and the developing device, and, as a result of the reduced pressure, the toner and the air flow are separated from one another and the toner falls into a hopper in the developing device. However, some of the air also flows into the hopper and to a fresh toner replenishing unit where the air is then easily released. In the fresh toner replenishing unit, fresh toner is mingled with the air and thus a portion of the fresh toner, due to the air current, flows out of an opening of the fresh toner replenishing unit. As a result, toner is undesirably scattered within the image forming apparatus, where the toner dirties sheets of paper, and an operator's hands when the operator changes a toner bottle, etc.

SUMMARY OF THE INVENTION

Accordingly, one object of this invention is to provide a novel method and system for conveying toner in an image forming apparatus that includes a toner collecting device.

It is another object of the present invention is to provide a toner collecting device capable of conveying collected toner with a simple construction.

It is yet another object of the present invention is to provide a toner collecting device capable of conveying with air collected toner in an image forming apparatus without scattering the toner therein.

In order to achieve the above-mentioned objects, according to the present invention, an image forming apparatus is provided that includes a cleaning device that removes toner on an image carrier, a developing device that develops with toner a latent image on the image carrier so as to make a toner image on the image carrier, a conveying device that conveys the removed toner to the developing device, a supplying device that supplies an air flow to the conveying device, a replenishing device that replenishes fresh toner to the developing device and a controlling device that controls the supplying device such that the supplying device stops supplying the air flow to the conveying device when the replenishing device replenishes the fresh toner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
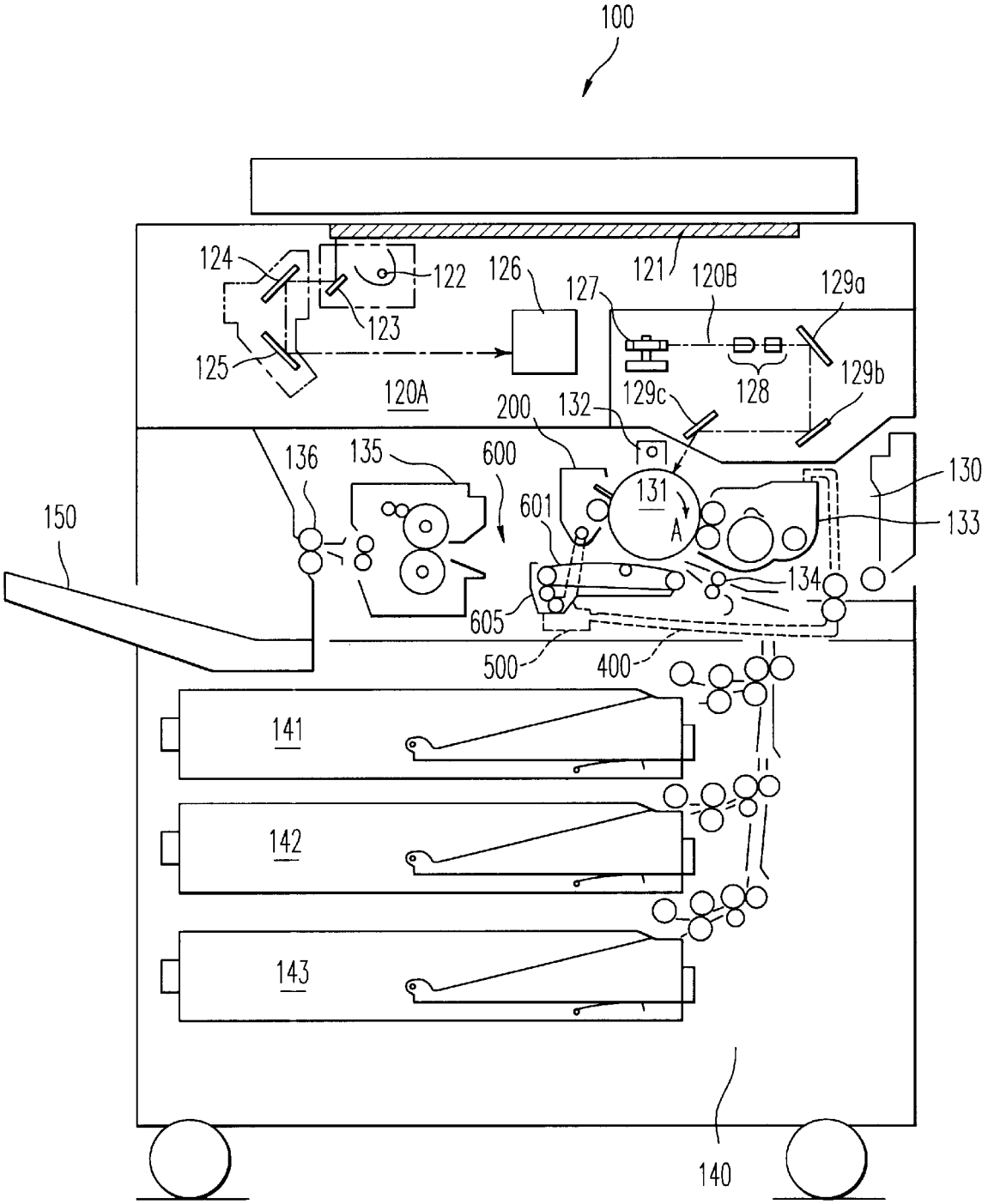
FIG. 1 is a schematic sectional view showing an image forming apparatus according to the present invention.

Referring now to the drawings, wherein like reference numerals designate identical or corresponding parts throughout the several views, and more particularly to FIG. 1 thereof, a copier 100 is generally made up of an original image reading section 120A, a writing section 120B, an image forming section 130 and a sheet feeding section 140.

The original image reading section 120A includes a glass platen 121 and a light source 122 that illuminates a document laid on the glass platen 121, where the reflected light from the document is incident on an image sensor 126, such as a charge coupled device CCD, via mirrors 123, 124 and 125. The writing section 120B includes an optical polygon 127, a lens system 128 and mirrors 129*a*, 129*b* and 129*c*. The reflected light from the optical polygon 127 is incident on a photoconductive drum 131 via the lens system 128 and mirrors 129*a*, 129*b* and 129*c*.

The image forming section 130 includes the photoconductive drum 131, a charger 132, exposing position (indicated by the arrow), a developing device 133, registration rollers 134, a transfer belt unit 600, a cleaning device 200 and a fixing device 135, all arranged as shown.

The sheet feeding section 140 includes a plurality of cassettes 141, 142 and 143 each being loaded with a stack of sheets of particular respective sizes.

In operation, the charger 132 charges the surface of the photoconductive drum 131 uniformly. The writing section 120B exposes the charged surface of the photoconductive drum 131 with a pattern that corresponds to a document image so as to form an electrostatic latent image. The developing device 133 develops the electrostatic latent image with a developer (either two component type developer or one component type developer) so as to form a corresponding toner image. The toner image is transferred from the photoconductive drum 131 to a sheet fed from the sheet feeding section 140 to an image transfer position via the registration rollers 134. The image transfer position is defined by a nip between the photoconductive drum 131 and a transfer belt 601 included in the transfer belt unit 600. The transfer belt 601 conveys the sheet to the fixing device 135 where the toner image is fixed to the sheet. The sheet with the toner image fixed thereon is then driven out of the apparatus to a tray 150 via discharge rollers 136.

After the image is transferred, the cleaning device 200 removes the residual toner, paper dust and other impurities remaining on the photoconductive drum 131. The residual toner removed from the collecting device 200 is selectively collected and conveyed (as will be discussed in detail) to the developing device 133. The residual toner on the transfer belt 601 is also removed from the transfer belt 601 by way of a belt cleaning device 605 and then collected and conveyed to the developing device 133.

Figure 2:
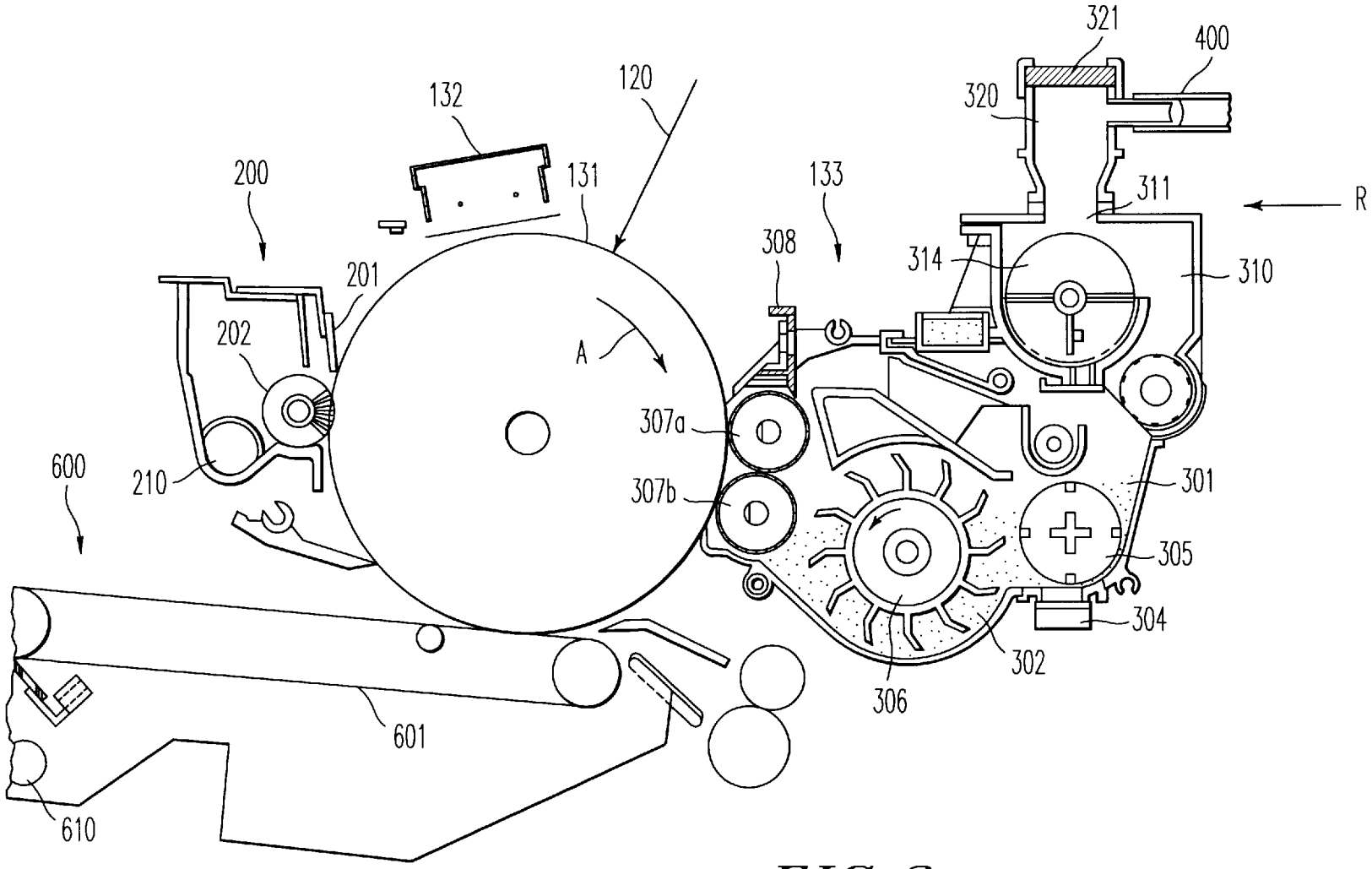
FIG. 2 is a fragmentary sectional view of the image forming apparatus of FIG. 1, according to a first embodiment of the present invention.

FIG. 2 shows a part of the image forming section 130, previously discussed with respect to FIG. 1. The developing device 133 uses a toner and carrier mixture, i.e., two component developer 302, where this two component developer 302 is included in a developer tank 301. In operation, when the toner images are formed on the photoconductive drum 131 by way of a pair of developing rollers 307*a* and 307*b*, toner density in the developing device 133 declines. In order to maintain a sufficient toner density in the developing device 133, fresh toner housed in the toner hopper 310 is released into the developer tank 301 so as to supplement the toner density in the developer tank 301. A toner density value, indicative of an amount of toner in the developer tank 301, is detected by a magnetic permeability sensor 304 and determined whether the toner density value is below a predetermined threshold value prior to replenishing the developer tank 301 with fresh toner from the toner hopper 310.

The toner replenished from the toner hopper 310 is mixed with the carrier in the developer tank 301 by an agitator roller 305 so that the developer 302 becomes triboelectrically charged. The developer 302 is scooped up to the developing roller 307*a* by way of a rotating scooping wheel 306. The scooped developer 302 remains charged and adheres to the surface of the developing roller 307*a* by way of a magnetic force acting between magnets disposed in the developing roller 307*a* and the charge on the developer 302. Subsequently, the developer 302 is conveyed toward the photoconductive drum 131 by a sleeve of the developing roller 307*a*, and surplus developer is removed by a developing doctor 308. The developer that is conveyed to the photoconductive drum 131 is transferred to the photoconductive drum 131 by way of a developing bias voltage.

Residual toner and carrier on the developing roller 307*a* are conveyed to the developer tank 301 via the developing roller 307*b*. Almost all, perhaps 90% or more, of the developed toner on the photoconductive drum 131 is transferred to the sheet by way of the transfer belt unit 600. However, about 10% toner on the photoconductive drum 131 may not be transferred to the sheet. This 10% residual toner is removed from the photoconductive drum 131 by way of a cleaning blade 201 and a brush roller 202, which are arranged as shown in FIG. 2. Residual toner removed by the cleaning blade 201 and the brush roller 200 is collected in the cleaning device 200, as shown.

Figure 3:
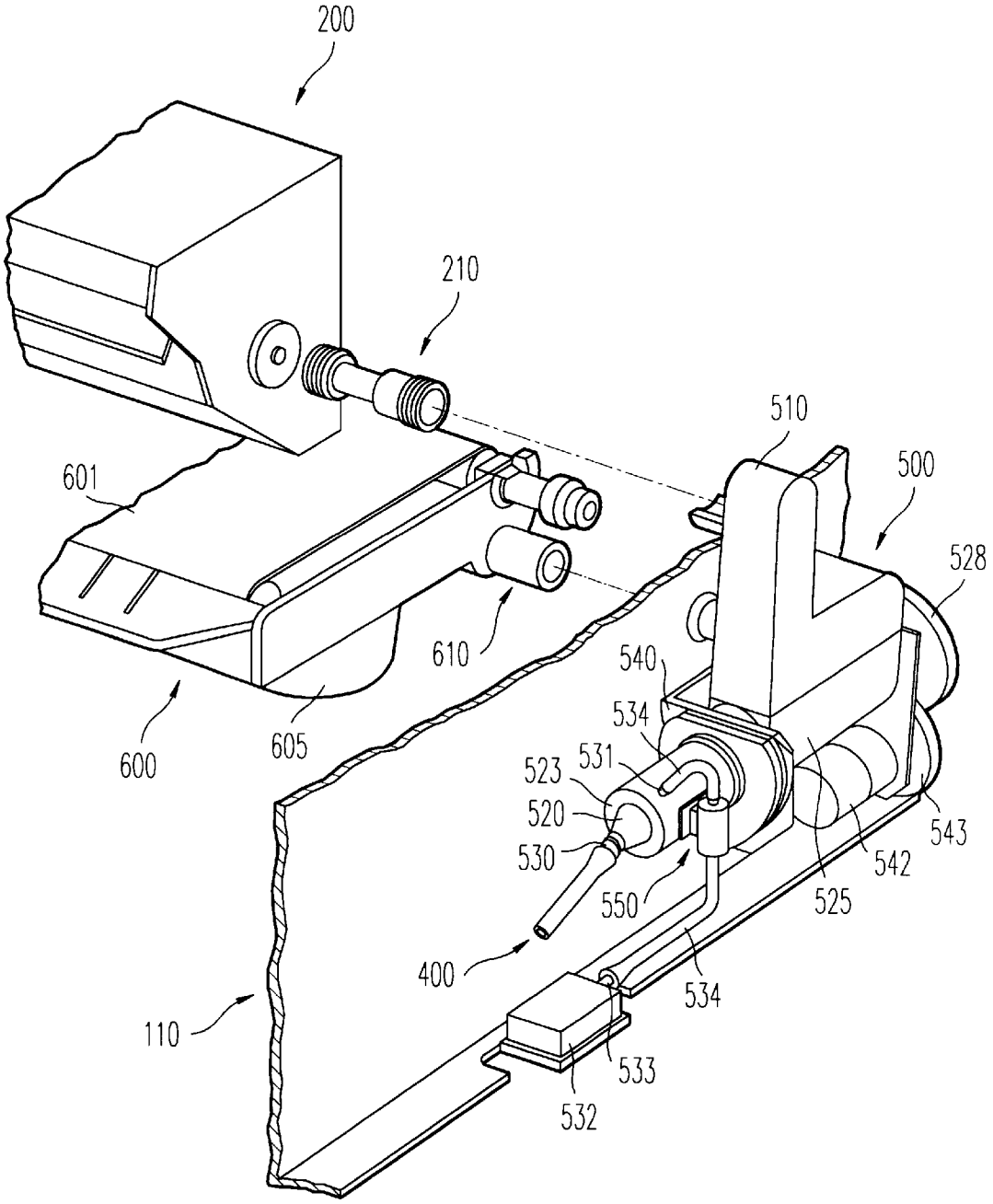
FIG. 3 is a fragmentary perspective view showing a toner conveying unit according to the first embodiment of the present invention.
Figure 4:
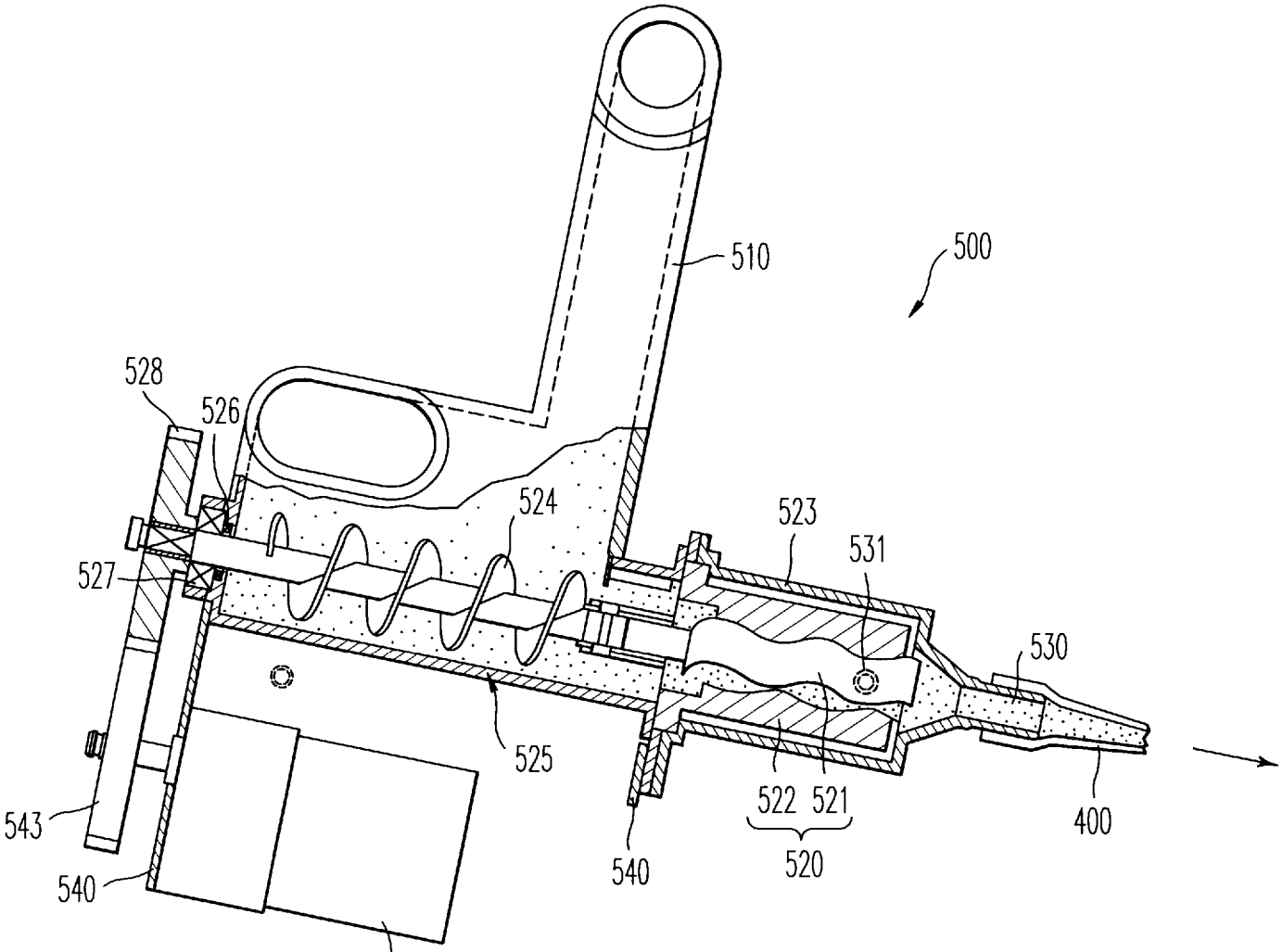
FIG. 4 is a fragmentary sectional view showing the toner conveying unit shown in FIG. 3.

FIGS. 3 and 4 show the toner collecting device for the copier of FIG. 1. Referring to FIG. 3, the toner collected by the cleaning device 200 is transferred from a toner outlet portion 210 of the cleaning device 200 to a toner guiding member 510 of the toner conveying unit 500. The toner guiding member 510 forms a passage for delivering the toner from the cleaning device 200 to a powder pump 520. Likewise, the toner collected by the belt cleaning device 605 is delivered to the toner guiding member 510 via a toner outlet portion 610 forming part of the transfer belt unit 600. The cleaning device 200, the transfer belt unit 600, the photoconductive drum 131, the developing device 133 and other image forming devices as well as the toner conveying unit 500 are mounted on a side wall 110 of the copier body 100, as shown.

As shown in FIG. 4, a screw 524 is provided toward the bottom of the toner conveying unit 500 to transport the collected toner from the toner guiding member 510 to the powder pump 520. The powder pump 520 of the toner conveying unit 500 uses a screw pump which is often called a Mono pump, that includes a rotor 521, a stator 522 and a holder 523 for the stator 522. The rotor 521 of the powder pump 520 is coaxially connected to one end of the screw 524. The other end of the screw 524 is supported via a seal member 526 by a bearing 527 affixed to a support member 540 and is held in mesh with a driven gear 528. A hopper 525 accommodating the screw 524 is engaged with the toner guiding member 510 supported by the support member 540 for conveying the toner to the powder pump 520. The powder pump 520 is mounted on the support member 540 via a holder 523 and connected to the hopper 525. A motor 542 is also mounted on the support member 540, and a driving gear 543 is mounted on an output shaft of the motor 542 and held in mesh with a driven gear 528. When the motor 542 is driven, the driving force is transmitted to the screw 542 and the rotor 521 via the driving gear 543 and the driven gear 528. As a result, the toner conveyed to the hopper 525 via the toner guiding member 510 is conveyed to the powder pump 520.

In the present embodiment, the rotor 521 of the powder pump 520 and the screw 524 are driven by the motor 542. Alternatively, the pump 520 may be connected to the driving system included in the copier for the purposes stated earlier.

The stator 522 is made of an elastic body such as rubber, and spiral grooves are formed on the inner surface of the stator 522. The stator 522 surrounds the outer surface of the rotor 521 so as to form a path for the rotor 521 and engages with the rotor 521. The outer surface of the stator 522 and the inner surface of the holder 523 are spaced by a gap of about 1 mm, where the gap communicates with a toner passage 530. An air inlet port 531 communicates with the gap in order to feed air under pressure to the toner passage 530. As shown in FIG. 3, the air inlet port 531 communicates with a tube 534 to an air outlet port 533 formed in an air pump 532 and an air sensor 550.

The air pump 532 feeds air under pressure to the collected toner via the air inlet port 531 at a rate about 0.5 liter to 1 liter per minute. The air serves to enhance the fluidity of the collected toner being driven out via the toner passage. This allows the powder pump 520 to convey the toner more effectively.

When the rotor 521 rotates, the collected toner in the toner conveying unit 500 is conveyed in the toner passage 530. Then the collected toner in the toner passage 530 is conveyed by an air flow fed from the air pump 532 to a joint 320 of the developing device 133 as shown in FIG. 2. According to the present embodiment, the collected toner is conveyed in the tube 400 (see FIGS. 2–4) by the air flow surely and easily.

Since the tube 400 is made of a flexible material that is highly resistive to toner, for example soft vinyl chloride, Nylon or Teflon, the conveying path can be set freely, and thus can be arranged in a variety of shapes.

Referring to FIG. 2, the lower portion of the joint portion 320 is tapered. An air filter 321 is provided in the upper portion of the joint portion 320 such that the surplus air flow escapes through the air filter 321 (because the air pressure in the joint 321 will tend to equalize with the external air pressure). However, the collected toner conveyed through the tube 400 is separated from the air because the collected toner falls toward the tapered end of the joint, positioned opposite to the air filter 321. The collected toner is then supplied to the toner hopper 310 via the tapered portion and a collected toner supplying outlet 311.

Figure 5:
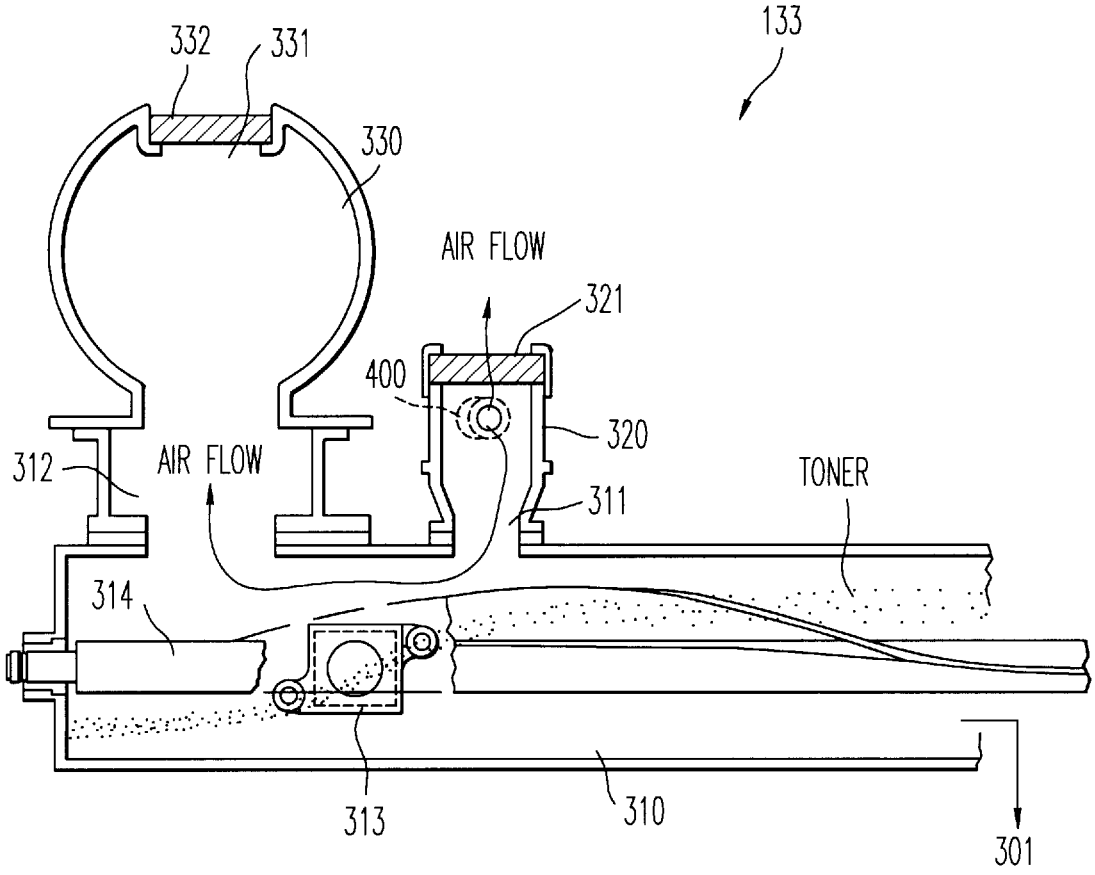
FIG. 5 is a fragmentary sectional view showing a fresh toner replenishing unit and a toner collecting portion of a developing device of the first embodiment of the present invention.

FIG. 5 shows a part of the developing device 133 that is seen from a direction "R" of FIG. 2. Referring to FIGS. 2 and 5, a fresh toner supplying outlet 312 and the collected toner supplying outlet 311 are provided in the toner hopper 310. A powder pressure toner sensor 313 is provided between the fresh toner supplying outlet 312 and the collected toner supplying outlet 311 in the toner hopper 310. When the powder pressure toner sensor 313 detects an empty toner condition, a toner bottle unit 330 is automatically actuated to supply the fresh toner through the fresh toner supplying outlet 312. The fresh toner is conveyed to the developing tank 301 by way of an auger 314 in the toner hopper 310.

The quantity of the toner on the left side of the toner hopper 310 is less than the right side in FIG. 5. Therefore, if the air flows into the joint portion 320 from the tube 400 via the collected toner supplying outlet 311, the air may flow into the toner hopper 310 and then toward the fresh toner supplying outlet 312. As a result, the fresh toner replenished from the fresh toner supplying outlet 312 and the air mix, enabling the mixture to flow out from minute openings such as at joined portions between the toner hopper 310 and the toner bottle unit 330.

In order to prevent the toner scattering in this way, according to the present embodiment, when the fresh toner is replenished, the air pump 532 is caused to stop operation so that the air is not supplied to the powder pump 520.

Figure 6:
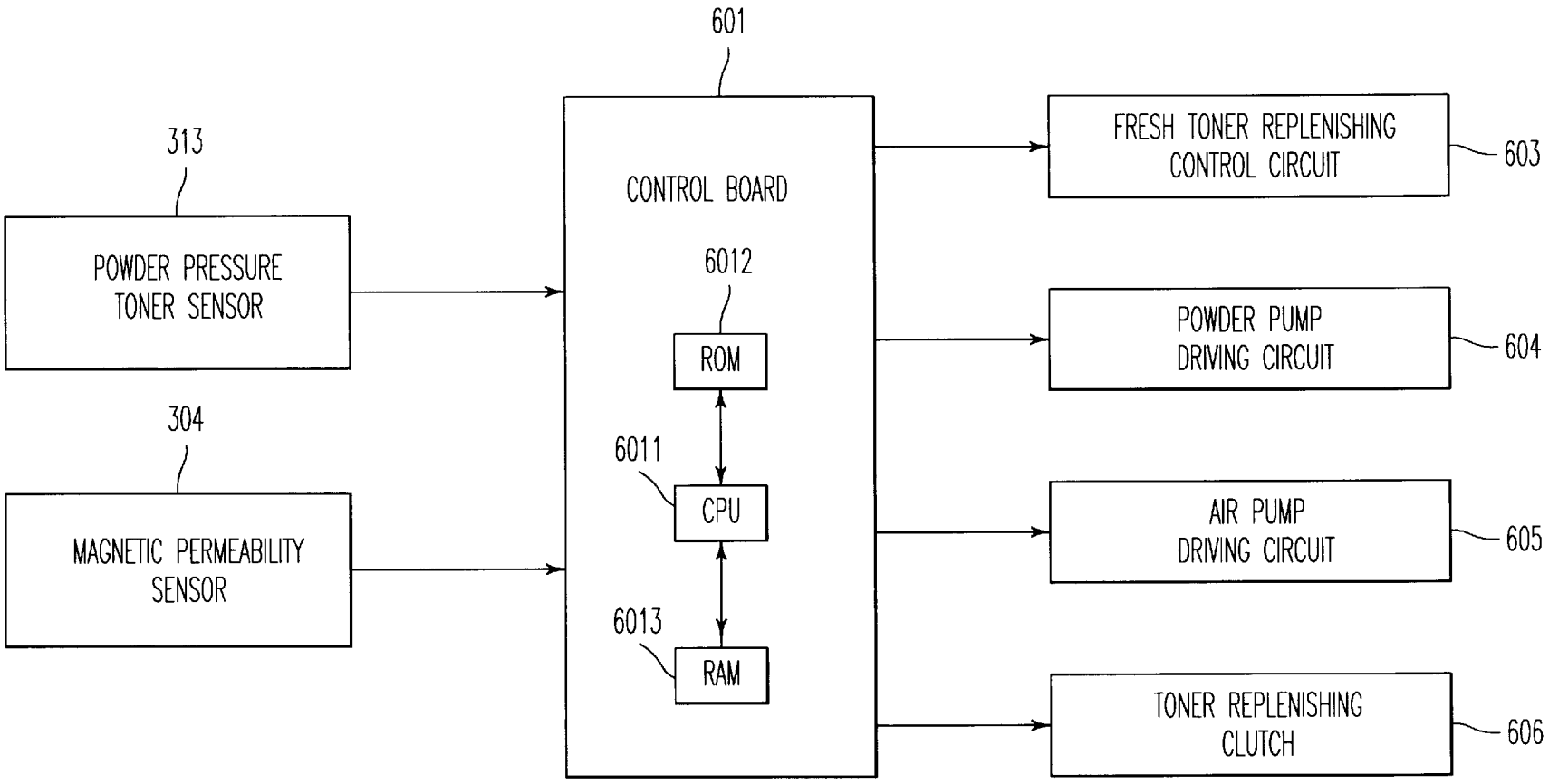
FIG. 6 shows a control circuit that controls a toner supplying operation for the first embodiment of the present invention.

FIG. 6 shows a control circuit for controlling a toner supplying operation. Referring to FIG. 6, output of the powder pressure toner sensor 313 and output of the magnet permeability sensor 304 are connected to a control board 601. The control board 601 includes a central processing unit (CPU) 6011, read-only-memory (ROM) 6012, random access memory (RAM) 6013 and input/output (IO) interface. An output of the control board 601 is connected to a fresh toner replenishing control circuit 603, a powder pump driving circuit 604, an air pump driving circuit 605 and a toner replenishing clutch 606 for replenishing the toner in the toner hopper 310. If the powder pressure sensor 313 outputs a toner empty signal to the control board 601, the control board 601 outputs a signal to an air pump driving circuit 605 to stop the operation of the air pump 532. Then, the fresh toner is replenished from the toner bottle unit 330 to the toner hopper 310.

Figure 7:
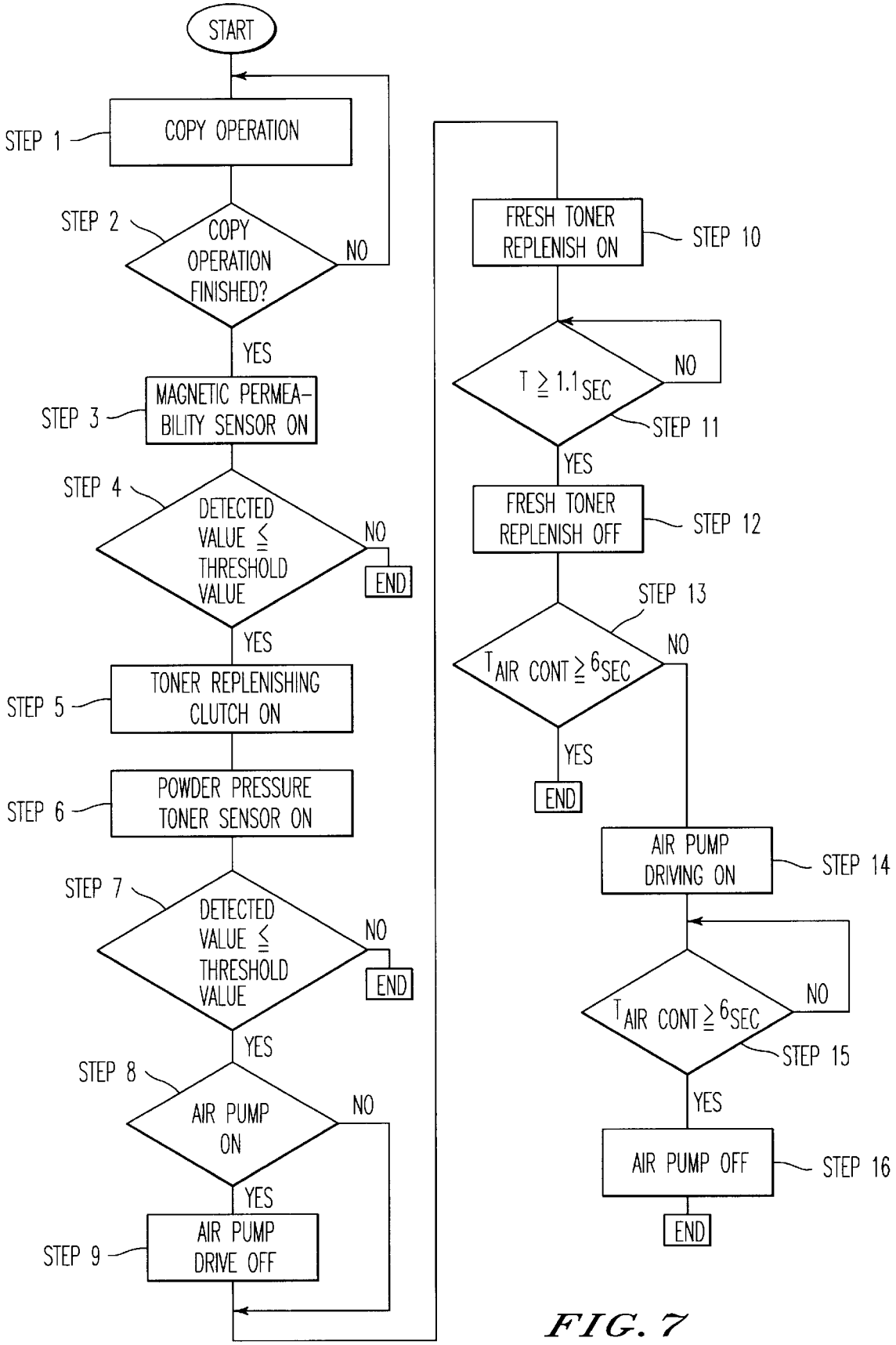
FIG. 7 is a flowchart illustrating a control process for the present invention.

FIG. 7 illustrates a flowchart of the control process implemented by the present invention. The process begins in Step 1 where a copying operation is performed. In Step 2 a determination is made if the copying operation is finished. If the results of Step 2 is negative, to process returns to Step 1. However, if the inquiry in Step 2 is affirmative, the magnetic permeability sensor 304 senses the magnetic permeability of the two component developer as an indicator of toner density. Subsequently, the process proceeds to Step 4 where an inquiry is made regarding whether the detected value is less than or equal to the threshold value. If the detected value is not more than the threshold value (Step 4), a toner replenishing clutch is turned on in Step 5 and the toner in the toner hopper 310 is replenished to the developer tank 301. Alternatively, the process ends. After the toner replenishing operation is finished in Step 5, the process proceeds to Step 6 where the powder pressure 313 is operated to detect the toner density in the toner hopper 310. If in Step 7 it is determined that the detected value is more than the threshold value, the process ends. Otherwise, the process proceeds to Step 8 where an inquiry is made regarding whether the air pump 532 is in an operating condition. If the air pump 532 is in the operating condition (Step 8), the air pump 532 is turned off in Step 9.

After Step 9 the process proceeds to Steps 10 and 11 where the toner bottle unit 330 replenishes the fresh toner in the toner hopper 310 for 1.1 seconds and then stops in Step 12. If the air pump 532 has not been operated for 6 seconds, including the time period before the air pump 532 was turned off, the air pump 532 is turned on again in Steps 13 and 14. Alternatively, if the air pump 532 has been operated within 6 seconds, including the time period before the air pump 532 was turned off, the air pump 532 is turned off in Steps 15 and 16, and the process ends.

As shown in FIG. 5, an opening 331 is formed on the top of the toner bottle unit 330 through which air from the collected toner outlet 311 flows. An air filter 332 is disposed at the opening 331, where the air filter 332 permits the air to pass there through, but blocks the toner from escaping.

According to the present embodiment, and as discussed above, the air flow is stopped from flowing toward the fresh toner supplying outlet 312 during the fresh toner replenishing operation, so as to avoid having toner scatter from the toner bottle unit 330 during the replenishment operation.

Figure 8:
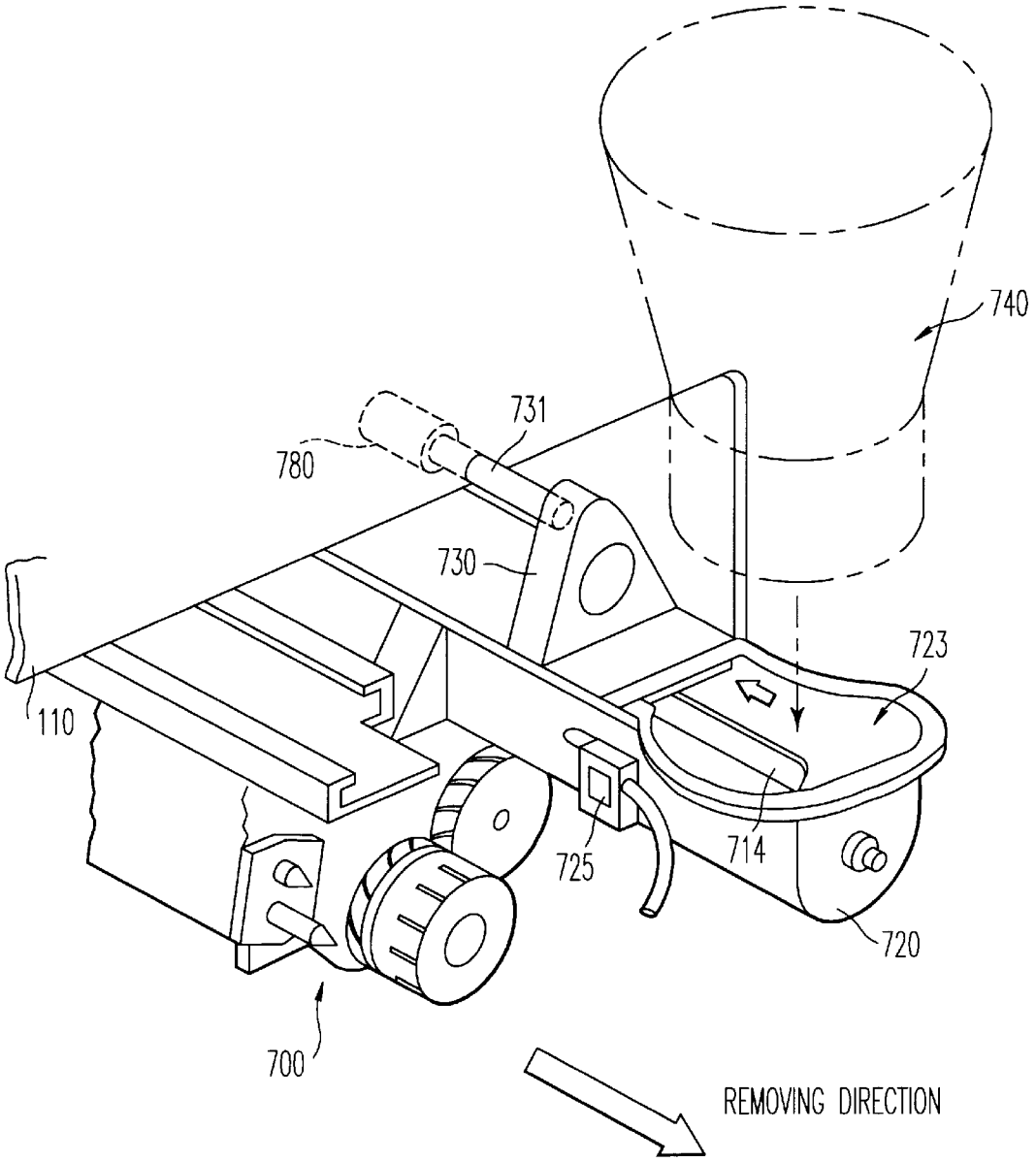
FIG. 8 is a perspective view of a developing device, toner hopper and toner bottle unit according to a second embodiment of the present invention.
Figure 9:
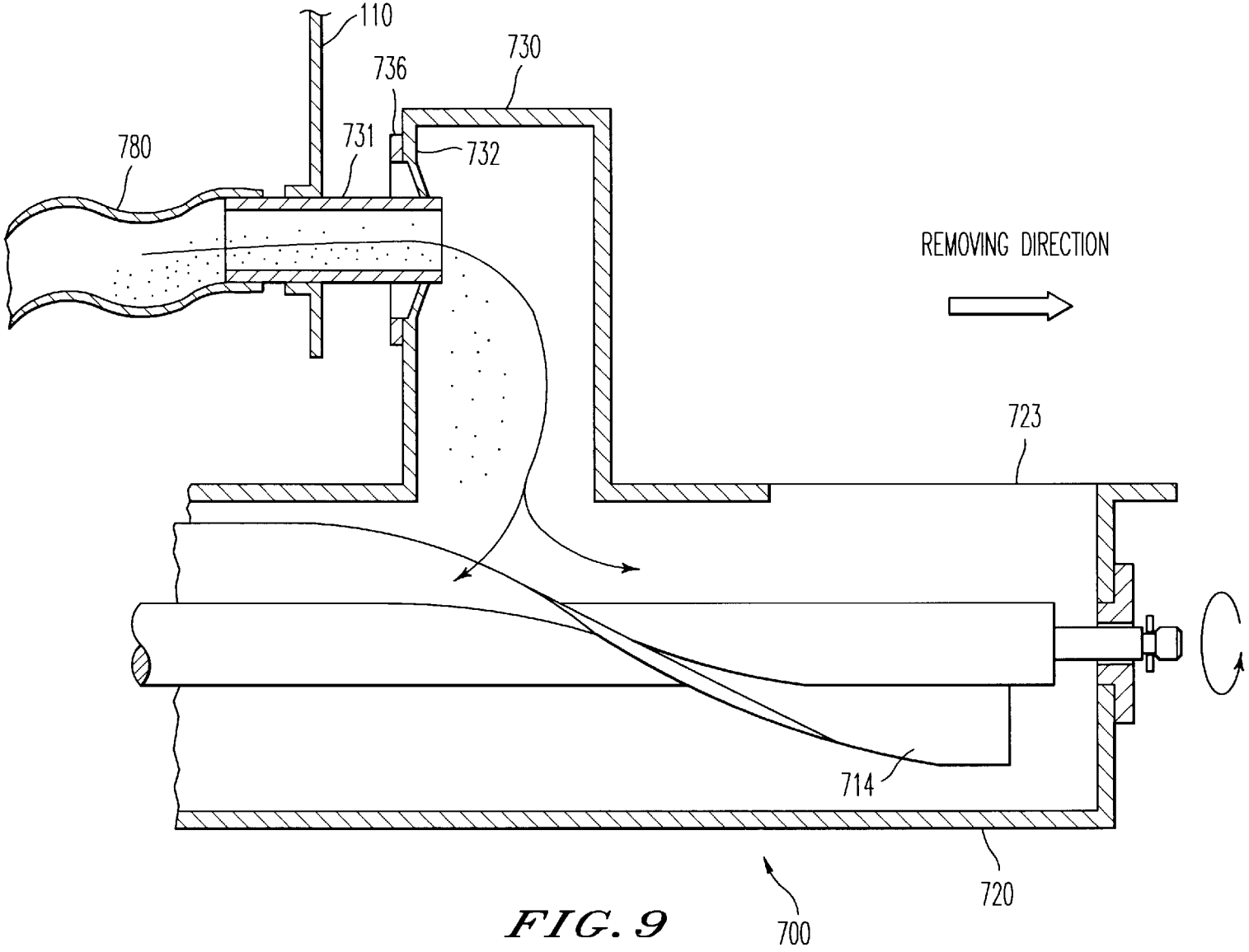
FIG. 9 is a fragmentary sectional view of a joint portion of a collected toner conveying structure and developing device according to second embodiment of the present invention.
Figure 10:
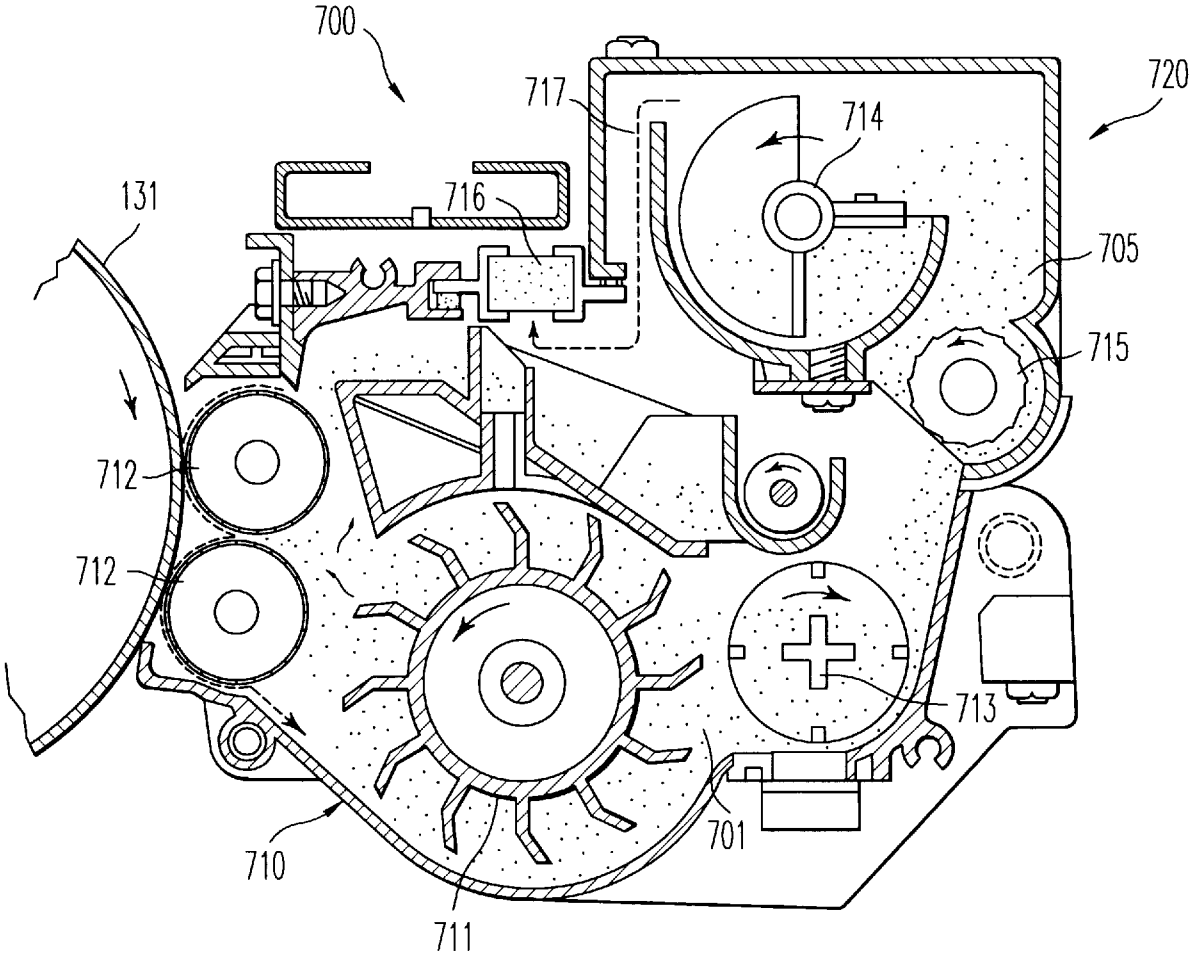
FIG. 10 is a sectional view of the developing device having an air path according to the second embodiment of the present invention.

FIGS. 8 to 10 show a second embodiment of the present invention where a filter, such as the filter 321 of the first embodiment, is omitted at a joint portion between a tube for conveying collected toner to a developing device and a toner hopper. Referring to FIG. 8, a developing device 700 can be removed from the copier 100 of FIG. 1 for maintenance operations, where a direction of removal is indicated by an arrow in FIG. 8. A toner hopper 720 may also be detached from the developing device 700.

In this second embodiment, toner replenishment is achieved by fresh toner being dispensed from a toner bottle unit 740 to a toner hopper 720. Removed toner from the photoconductive drum 131 is also supplied to the toner hopper 720. The toner bottle unit 740 is detachably mounted on the toner hopper 720, as shown.

When a toner density sensor 725 senses that an amount of toner in the toner hopper 720 is less than a predetermined amount (e.g., empty), a toner replenishing signal is outputted from the sensor 725 to the toner bottle unit 740. In response to the toner replenishing signal, the toner bottle unit 740 replenishes the toner by adding fresh toner to the toner hopper 720 via an opening 723. The replenished toner is conveyed in a direction indicated by an arrow in the toner hopper 720 by way of an agitator 714. When a predetermined quantity of toner reaches the toner density sensor 725, the fresh toner replenishing operation is completed (as determined for example by the toner density sensor 725 or after a predetermined toner-dispensing time has elapsed). Because the collected toner conveying structure of this embodiment is the same as that employed in the first embodiment, an explanation about the collected toner conveying structure is omitted for this second embodiment.

FIG. 9 shows a joint portion of the collected toner conveying structure and the toner hopper 720, which cooperate without the need for an air filter. Referring to FIG. 9, an end of a tube 780 that is opposite to first end connected to a powder pump (such as that discussed with respect to the first embodiment) is connected to a toner discharging tube 731 that is fixed to the side wall 110 of the copier 100 (FIG. 1). The toner discharging tube 731 is inserted in a toner guiding member 732 via a seal 736, as shown. The collected toner conveyed by the powder pump with the air flow is conveyed to the toner hopper 720 via the tube 780 and the toner discharging tube 731. Then, the collected toner is supplied to an agitator 714 by the force of gravity so that the collected toner may be mixed with the fresh toner by the agitator 714.

In the present embodiment, the powder pump is controlled to stop operating if the toner density sensor 725 senses that the toner volume is less than a predetermined amount (e.g., empty). After the collected toner conveying operation is stopped, the toner bottle unit 740 starts to replenish the fresh toner, and once the fresh toner replenishing operation is finished, the powder pump automatically resumes operation under control of the control circuit (FIG. 6, or alternatively after a predetermined time interval). Since these operation are the same as the first embodiment as shown and discussed with respect to FIGS. 6 and 7, a redundant explanation is omitted.

FIG. 10 shows the developing device 700 in detail. The developing device 700 includes a developing section 710 having developing rollers 712 for developing an electrostatic latent image on the photoconductive drum 131, a paddle 711 for agitating two component developer and a toner replenishing section 720 for replenishing toner to the developing section 710. The developer is agitated and conveyed by way of the paddle 711, the developing rollers 712 and an agitator 713 when executing a developing operation. Fresh toner is dispensed from the toner replenishing section 720 to the developing section 710 by way of a toner replenishing roller 715. In the toner replenishing section 720, the fresh toner which is replenished from the toner bottle unit 740 is conveyed toward the toner replenishing roller 715 by the agitator 714, where the toner replenishing roller 715 releases fresh toner to the developing section 710. In the developing section 710, the fresh toner drops on an agitator 713 where the fresh toner is mixed with the two component developer 701. Alternatively, one component developer may be used instead of the two component developer.

In order to reduce the risk of an internal atmospheric pressure in the developing section 710 from becoming excessively high during a developing operation, a filter 716 is provided on the top of the developing section 710 that serves as a vent. The filter 716 is a felt material made of polyethylene-terephthalate fiber, nylon or glass fiber that allows air, but not toner, to pass there through. Thus, as illustrated, an air path 717 is provided between the toner replenishing section 720 and the developing section 710 for reducing the internal pressure in the toner replenishing section 720. In order to prevent the toner from blocking the air path 717, a top end of a side wall is higher than a highest surface of the toner in the toner replenishing section 720.

The collected toner is also conveyed to the toner replenishing section by way of the powder pump. The collected toner is then dropped on the agitator 714 and is mixed with the fresh toner by way of the agitator 714. The air flow from the powder pump passes through the air path 717 and then flows out through the filter 716.

According to the present embodiment, when the fresh toner is replenished, the air pump stops operating so that air is not supplied to the powder pump, and therefore, unlike the first embodiment, the air filter which separates the air flow from the collected toner can be omitted.

The control and activation mechanisms and processes set forth in the present description may be implemented using a conventional general purpose microprocessor programmed according to the teachings in the present specification, as will be appreciated to those skilled in the relevant art(s). Appropriate software coding can readily be prepared by skilled programmers based on the teachings of the present disclosure, as will also be apparent to those skilled in the relevant art(s).

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus comprising:

developing means for developing a latent image with toner and making a toner image on an image carrier for subsequent transfer to a transfer medium;

cleaning means for removing residual toner on said image carrier after the toner image is transferred;

means for conveying the residual toner from said cleaning means to said developing means;

means for supplying an air flow to said conveying means;

means for replenishing said developing means with fresh toner; and means for controlling said means for supplying such that said means for supplying stops supplying the air flow to said means for conveying when said means for replenishing replenishes the fresh toner.

2. An apparatus as claimed in claim 1, wherein said means for conveying comprises a screw pump including a rotor and a stator, said screw pump being configured to convey said residual toner in an axial direction of said rotor.

3. An apparatus as claimed in claim 2, wherein said means for conveying comprises a tube in which said residual toner is conveyed with said air flow supplied by said means for supplying.

4. An apparatus as claimed in claim 1, wherein said conveying means includes an air filter from which air, of said air flow, escapes.

5. An apparatus as claimed in claim 1, further comprising a toner hopper that is replenished with said fresh toner and said residual toner conveyed by said means for conveying.

6. An apparatus as claimed in claim 5, wherein:

said developing means comprises said toner hopper and a developing device in which a developing roller is disposed; and an air path being positioned between said toner hopper and said developing device.

7. An apparatus as claimed in claim 6, wherein said developing device includes an air filter through which air from said toner hopper escapes from said developing device.

8. An image forming apparatus comprising:

a developer that develops a latent image and makes a toner image on an image carrier for subsequent transfer to a transfer medium;

a cleaning device positioned adjacent to said image carrier and configured to remove residual toner from said image carrier after said toner image is transferred from said image carrier;

a powder pump having a rotor and a stator adapted to convey collected toner from said cleaning device in an coaxial direction of said rotor;

an air pump that supplies an air flow to said powder pump, said powder pump conveying said residual toner with said air flow in a tube connected to said developing device via a joint;

a fresh toner replenishing device coupled to said developing device and controllably configured to replenish fresh toner to said developing device; and a control circuit that controls said air pump such that said air pump stops supplying the air flow to said powder pump while said replenishing device replenishes the fresh toner.

9. An apparatus as claimed in claim 8, wherein said joint includes an air filter through which air of said air flow escapes from said developing device.

10. An apparatus as claimed in claim 8, wherein:

said developing device comprises a toner hopper that is replenished with said fresh toner and said residual toner.

11. An apparatus as claimed in claim 10, wherein said developing device includes a developing section and an air path positioned between said toner hopper and the developing section.

12. An apparatus as claimed in claim 11, wherein said developing section includes an air filter from which air from said toner hopper escapes.

13. A method of supplying toner in an image forming apparatus, comprising the steps of:

developing a latent image with toner and making a toner image on an image carrier for subsequent transfer to a transfer medium;

removing residual toner on said image carrier after the toner image is transferred;

conveying the residual toner to a developer that performs said developing step, comprising the step of supplying an air flow to assist in the conveyance of said residual toner;

replenishing said developer with fresh toner; and stopping the air flow when performing said replenishing step.

14. The method of claim 13, wherein said conveying step comprises conveying said residual toner in an axial direction of a rotor used to convey said residual toner in said conveying step.

15. The method of claim 14, wherein said conveying step comprises conveying said residual toner with said air flow in a tube.

16. The method of claim 13, wherein said conveying step comprises releasing air from said air flow via an air filter.

17. The method of claim 13, wherein said replenishing step comprises replenishing a toner hopper in said developer with said fresh toner and said residual toner.

* * * * *